US006877340B2

(12) United States Patent
Hiwata et al.

(10) Patent No.: US 6,877,340 B2
(45) Date of Patent: Apr. 12, 2005

(54) EXPANDER

(75) Inventors: Akira Hiwata, Kyoto (JP); Noboru Iida, Shiga (JP)

(73) Assignee: Matsushita Electric Industrial Co., Ltd., Kodama (JP)

( * ) Notice: Subject to any disclaimer, the term of this patent is extended or adjusted under 35 U.S.C. 154(b) by 0 days.

(21) Appl. No.: 10/657,182

(22) Filed: Sep. 9, 2003

(65) Prior Publication Data

US 2004/0074256 A1 Apr. 22, 2004

(30) Foreign Application Priority Data

Oct. 18, 2002 (JP) ..... 2002-303982

(51) Int. Cl.[7] ..... F25B 9/00; F25B 1/00; F25B 41/06; F01C 1/00

(52) U.S. Cl. ..... 62/527; 62/498; 62/87; 418/268

(58) Field of Search ..... 62/527, 498, 87, 62/278, 510; 418/268, 23, 93

(56) References Cited

U.S. PATENT DOCUMENTS

| | | | | |
|---|---|---|---|---|
| 1,539,728 A | | 5/1925 | Ensign | |
| 4,174,931 A | | 11/1979 | Ishizuka | 418/259 |
| 4,248,575 A | | 2/1981 | Watanabe et al. | 418/93 |
| 4,455,129 A | | 6/1984 | Sakitani et al. | 418/82 |
| 4,498,853 A | | 2/1985 | Sakamaki et al. | 418/268 |
| 4,516,920 A | * | 5/1985 | Shibuya | 418/23 |
| 5,327,745 A | | 7/1994 | Gilmour | 62/467 |
| 6,178,761 B1 | * | 1/2001 | Karl | 62/159 |
| 6,321,564 B1 | | 11/2001 | Yamanaka et al. | 62/510 |

FOREIGN PATENT DOCUMENTS

| | | | | |
|---|---|---|---|---|
| DE | 1 503 590 | | 7/1969 | |
| DE | 2 261 873 | | 6/1974 | |
| DE | 25 44 232 | | 7/1976 | |
| DE | 2544232 A | * | 7/1976 | F01C/1/34 |
| JP | 57-108555 | | 7/1982 | |
| JP | 62-77562 | | 4/1987 | |
| JP | 10-19401 | | 1/1998 | |
| JP | 2001066006 A | * | 3/2001 | F25B/13/00 |
| JP | 2001-108257 | | 4/2001 | |
| JP | 2001-207983 | | 8/2001 | |
| WO | WO 99/02862 | | 1/1999 | |
| WO | 99/02862 | | 1/1999 | |
| WO | 02/18848 A1 | | 3/2002 | |

OTHER PUBLICATIONS

Robinson et al., "Efficiencies of transcritical $CO_2$ cycles with and without an expansion turbine", *Int. J. Refrig.*, vol. 21, No. 7, pp. 577–589, 1998.

Douglas M. Robinson et al. "Efficiencies of transcritical $CO_2$ cycles with and without an expansion turbine"; International Journal of Refrigeration, vol. 21, No. 7, Nov. 1998 (pp. 577–589).

* cited by examiner

*Primary Examiner*—Chen Wen Jiang
(74) *Attorney, Agent, or Firm*—Armstrong, Kratz, Quintos, Hanson & Brooks, LLP

(57) ABSTRACT

It is an object of the present invention to reduce the constraint that the density ratio is constant as small as possible, and to obtain high power recovering effect in a wide operation range by using an expander which is operated in accordance with a flowing direction of refrigerant. An expander used in a refrigeration cycle uses carbon dioxide as refrigerant and has a compressor, an outdoor heat exchanger and an indoor heat exchanger. The expander comprises a cylindrical cylinder, a rotor which rotates in the cylinder, a vane which divides an expansion space formed between an inner peripheral surface of the cylinder and an outer peripheral surface of the rotor into a plurality of spaces, and a vane groove provided in the rotor for accommodating the vane therein. The vane groove is provided with a back pressure chamber which pushes the vane against the inner peripheral surface of the cylinder, and the refrigerant in the supercritical state is introduced into the back pressure chamber.

7 Claims, 4 Drawing Sheets

EXPANDER

TECHNICAL FIELD

The present invention relates to an expander used in a refrigeration cycle using carbon dioxide as refrigerant and having a compressor, an outdoor heat exchanger and an indoor heat exchanger.

BACKGROUND TECHNIQUE

In recent years, attention is focused on a refrigeration cycle apparatus using, as refrigerant, carbon dioxide ($CO_2$, hereinafter) in which ozone destroy coefficient is zero and global warming coefficient is extremely smaller than Freon.

There is proposed a refrigeration cycle apparatus using $CO_2$ refrigerant in which expansion energy of a working medium is recovered using an expander instead of an expansion valve, thereby enhancing coefficient of performance of the refrigeration cycle apparatus. It is proposed to use a swash plate expander as this expander (see patent document 1 for example).

[Patent Document 1]

Japanese Patent Application Laid-open No.2001-141315 (FIG. 2)

In the present invention, a sliding vane type expander is employed as the expander. In the sliding vane type expander, since the vane jumps, a large sound is generated and a hitch is generated in a tip end of the vane. If a back pressure is insufficient, a leakage from the tip end of the vane is increased, and a leakage loss is generated.

Such problems are solved if lubricant discharged into a high pressure chamber is supplied to a back surface of the vane, but a structure for supplying the lubricant becomes complicated.

If a spring is disposed in a back surface of the vane, a reliability between contact surfaces of the spring and the vane is deteriorated, and if high pressure refrigerant gas is supplied, since the refrigerant is gas, the leakage loss is adversely increased.

It is an object of the present invention to provide an expander in which its structure is simple, the leakage loss is small and the expander is operated reliably, by utilizing refrigerant in the supercritical state.

SUMMARY OF THE INVENTION

A first aspect of the invention provides an expander used in a refrigeration cycle using carbon dioxide as refrigerant and having a compressor, an outdoor heat exchanger and an indoor heat exchanger, wherein the expander comprises a cylindrical cylinder, a rotor which rotates in the cylinder, a vane which divides an expansion space formed between an inner peripheral surface of the cylinder and an outer peripheral surface of the rotor into a plurality of spaces, and a vane groove provided in the rotor for accommodating the vane therein, and wherein the vane groove is provided with a back pressure chamber which pushes the vane against the inner peripheral surface of the cylinder, and the refrigerant in the supercritical state is introduced into the back pressure chamber.

According to this aspect, by introducing the refrigerant in the supercritical state, since the refrigerant is not in the gas state, it is possible to reduce the leakage of refrigerant from a gap between a vane groove and a vane.

According to a second aspect of the invention, in the expander of the first aspect, the expander further comprises a suction pipe which introduces refrigerant into the expansion space, and a portion of refrigerant flowing through the suction pipe is introduced into the back pressure chamber. Since it is unnecessary to separately introduce refrigerant from outside of the expander, the mechanism can be simplified.

According to a third aspect of the invention an invention, in the expander of the first aspect, no oil reservoir is provided in a hausing which includes the cylinder or the rotor therein. By utilizing the oil mist discharged from the compressor for lubricating the expander, it is possible to form a refrigeration cycle apparatus in which a plurality of oil reservoirs do not exist, and it is possible to avoid a problem that oil level in each of the plurality of oil reservoirs must be controlled.

A fourth aspect of the invention provides a refrigeration cycle apparatus having a refrigeration cycle using carbon dioxide as refrigerant and having a compressor, an outdoor heat exchanger, an expander and an indoor heat exchanger, the refrigeration cycle apparatus including, in the refrigeration cycle, a first four-way valve to which a discharge side pipe and a suction side pipe of the compressor are connected, and a second four-way valve to which a refrigerant-inflow side pipe and a refrigerant-outflow side pipe of the expander are connected, wherein using, as the expander, a sliding vane type expander having a cylindrical cylinder, a rotor which rotates in the cylinder, a vane which divides an expansion space formed between an inner peripheral surface of the cylinder and an outer peripheral surface of the rotor into a plurality of spaces, and a vane groove provided in the rotor for accommodating the vane therein, refrigerant flowing through a pipe extending from the second four-way valve to a refrigerant-inflow port of the expander is introduced into a back surface of the vane.

A fifth aspect of the invention provides a refrigeration cycle apparatus having a refrigeration cycle using carbon dioxide as refrigerant and having a compressor, an outdoor heat exchanger, an expander and an indoor heat exchanger, the refrigeration cycle apparatus including, in the refrigeration cycle, a first four-way valve to which a discharge side pipe and a suction side pipe of the compressor are connected, and a second four-way valve to which a refrigerant-inflow side pipe and a refrigerant-outflow side pipe of the expander are connected, wherein using, as the expander, a sliding vane type expander having a cylindrical cylinder, a rotor which rotates in the cylinder, a vane which divides an expansion space formed between an inner peripheral surface of the cylinder and an outer peripheral surface of the rotor into a plurality of spaces, and a vane groove provided in the rotor for accommodating the vane therein, refrigerant flowing through a pipe extending from a discharge port of the compressor to the first four-way valve is introduced into a back surface of the vane.

According to the fourth and fifth aspects, by introducing the refrigerant in the supercritical state, since the refrigerant is not in the gas state, it is possible to reduce the leakage of refrigerant from a gap between a vane groove and a vane, and the refrigeration cycle apparatus can be applied to a cooling and heating air conditioner.

According to a sixth aspect of the invention, in the refrigeration cycle apparatus of fourth or fifth aspect, the expander is lubricated by oil mist discharged from the compressor. It is possible to form a refrigeration cycle apparatus in which a plurality of oil reservoirs do not exist, and it is possible to avoid a problem that oil level in each of the plurality of oil reservoirs must be controlled.

A seventh aspect of the invention provides a compressor used in a refrigeration cycle using carbon dioxide as refrigerant and having an outdoor heat exchanger and an indoor heat exchanger, wherein the compressor comprises a cylindrical cylinder, a rotor which rotates in the cylinder, a vane which divides a compression space formed between an inner peripheral surface of the cylinder and an outer peripheral surface of the rotor into a plurality of spaces, and a vane groove provided in the rotor for accommodating the vane therein, and wherein the vane groove is provided with a back pressure chamber which pushes the vane against the inner peripheral surface of the cylinder, and the refrigerant in the supercritical state is introduced into the back pressure chamber.

According to the seventh aspect, by introducing the refrigerant in the supercritical state, since the refrigerant is not in the gas state, it is possible to reduce the leakage of refrigerant from a gap between a vane groove and a vane.

According to an eighth aspect of the invention, in the compressor of the seventh aspect, the compressor further comprises a discharge pipe which discharges refrigerant from the compression space, wherein a portion of refrigerant flowing through the discharge pipe is introduced into the back pressure chamber. Since it is unnecessary to separately introduce refrigerant from outside of the compressor, the mechanism can be simplified.

PREFERRED EMBODIMENTS

An expander according to an embodiment of the present invention will be explained below with reference to the drawings.

Figure 1:
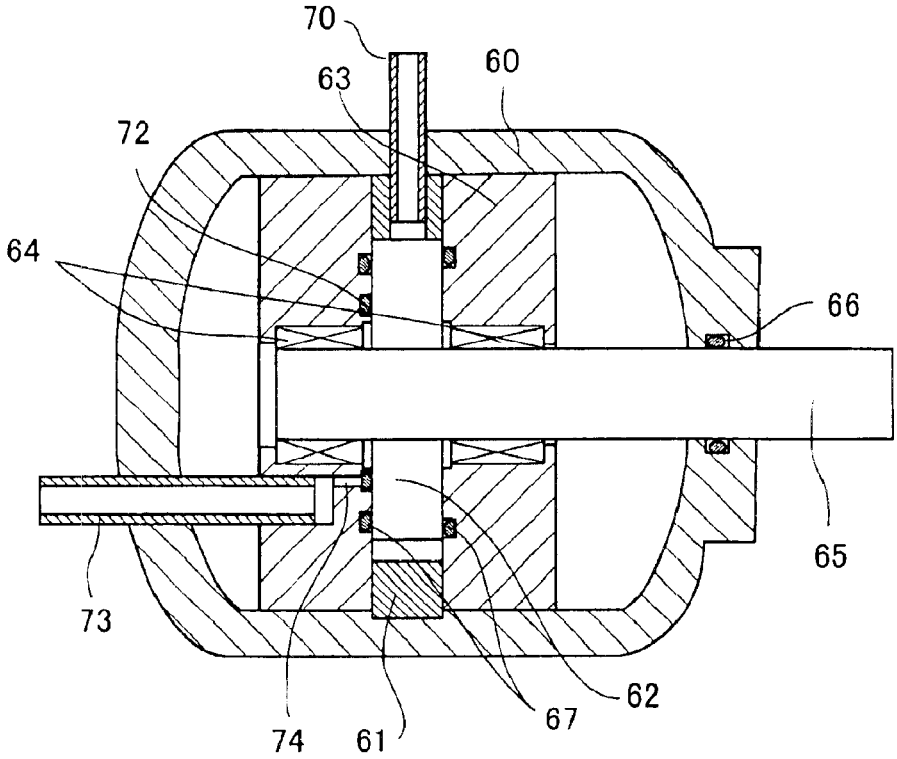
FIG. 1 is a side sectional view of an expander according to an embodiment of the present invention.
Figure 2:
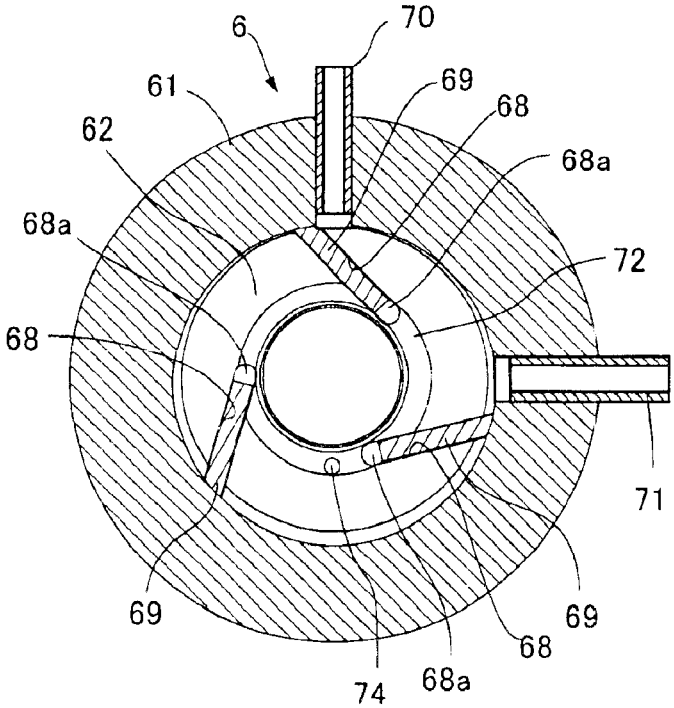
FIG. 2 shows a structure of an expanding portion of the expander.

FIG. 1 is a side sectional view of the expander of this embodiment. FIG. 2 shows a structure of an expanding portion of the expander.

The expander 6 of this embodiment is a sliding vane type expander. The sliding vane type expander has a hausing 60, and the hausing 60 is provided therein with a cylindrical cylinder 61 and a columnar rotor 62 which rotates in the cylinder 61. The cylinder 61 and the rotor 62 are sandwiched from their both sides by two side plates 63, and an expansion space are formed therebetween. Each of the side plates 63 is provided at its central portion with a bearing 64. A rotation shaft 65 is rotatably held by the bearing 64. Rotation of the rotor 62 is output to outside by this rotation shaft 65. A high pressure seal 66 is provided between the rotation shaft 65 and a hausing 60. A side seal 67 is provided between the side plate 63 and the rotor 62.

The rotor 62 includes a plurality of vane grooves 68. A vane 69 is slidably disposed in the vane groove 68. A back pressure chamber 68*a* is formed in the vane groove 68 at a location closer to a center of the rotor 62. The vane 69 is pushed against an inner peripheral surface of the cylinder 61 by a pressure of the back pressure chamber 68*a*.

The cylinder 61 is provided with a suction pipe 70 and a discharge pipe 71. The suction pipe 70 and the discharge pipe 71 are in communication with the expansion space.

A ring-like fluid supply groove 72 is formed in a contact surface of the side plate 63 with respect to the rotor 62. The fluid supply groove 72 is formed at a location where the fluid supply groove 72 is always in communication with the back pressure chamber 68*a*. The fluid supply groove 72 is in communication with the back pressure chamber 68*a* through the fluid supply hole 74 and the fluid supply pipe 73 which introduce refrigerant in a supercritical state from outside.

The operation of the expander of this embodiment will be explained below.

In FIG. 2, high pressure refrigerant in the supercritical state introduced from the suction pipe 70 enters into the expansion space formed between the inner peripheral surface of the cylinder 61 and an outer peripheral surface of the rotor 62, and is expanded while rotating the rotor 62 in a counterclockwise direction, and is discharged from the discharge pipe 71.

High pressure refrigerant in the supercritical state introduced from the fluid supply hole 74 is introduced into the fluid supply groove 72 through the fluid supply hole 74. The high pressure refrigerant introduced into the fluid supply groove 72 is introduced into the back pressure chamber 68*a* and functions to push the vane 69 against the inner peripheral surface of the cylinder 61.

Since the refrigerant in the supercritical state is introduced into the back pressure chamber 68*a* in this manner, it is possible to reduce the leakage of refrigerant from a gap between the vane groove 68 and the vane 69 as compared with refrigerant in a gas state, and it is possible to reliably push the vane against the inner peripheral surface of the cylinder 61.

Although this embodiment has been explained using the fluid supply hole 74 which introduces the refrigerant in the supercritical state from outside, a communication path which introduces a portion of refrigerant of the suction pipe 70 into the fluid supply groove 72 may be formed in the side plate without using the fluid supply hole 74. If a portion of refrigerant flowing through the suction pipe 70 is introduced into the back pressure chamber 68*a* in this manner, since it is unnecessary to separately introduce refrigerant from outside of the expander 6, it is possible to simplify the mechanism.

A refrigeration cycle apparatus using an expander according to the embodiment of the present invention will be explained with reference to the drawing based on a heat pump type cooling and heating air conditioner.

Figure 3:
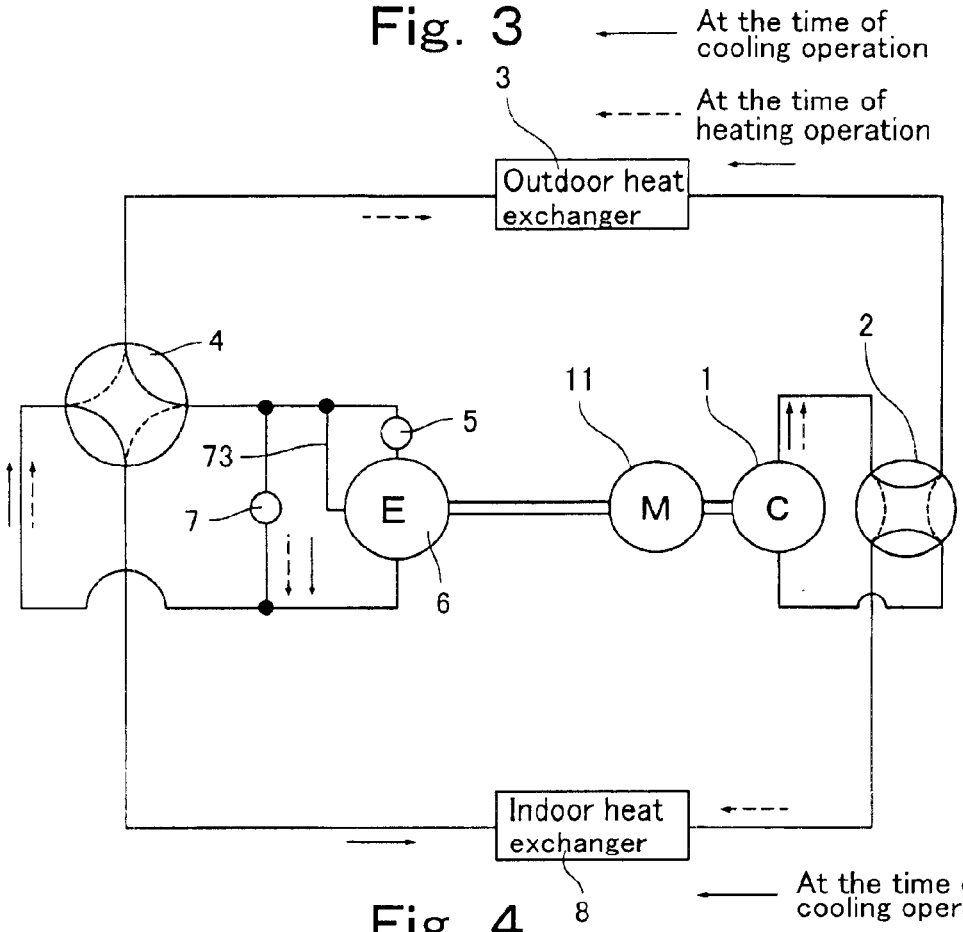
FIG. 3 shows a structure of a heat pump type cooling and heating air conditioner of the embodiment.

FIG. 3 shows a structure of the heat pump type cooling and heating air conditioner of this embodiment.

As shown in FIG. 3, the heat pump type cooling and heating air conditioner of this embodiment uses a $CO_2$ refrigerant as refrigerant, and comprises a refrigerant circuit in which a compressor 1 having a motor 11, an outdoor heat exchanger 3, an expander 6 and an indoor heat exchanger 8 are connected to one another through pipes.

The expander 6 is provided at its inflow side pipe with a pre-expansion valve 5.

A bypass circuit which bypasses the pre-expansion valve 5 and the expander 6 is provided in parallel to the pre-expansion valve 5 and the expander 6. The bypass circuit is provided with a control valve 7.

A drive shaft of the expander 6 and a drive shaft of the compressor 1 are connected to each other, and the compressor 1 utilizes power recover by the expander 6 for driving.

The refrigerant circuit is provided with a first four-way valve 2 to which a discharge side pipe and a suction side pipe of the compressor 1 are connected, and a second four-way valve 4 to which a refrigerant-inflow side pipe of the pre-expansion valve 5, a refrigerant-outflow side pipe of the expander 6 and the bypass circuit are connected.

The fluid supply pipe 73 introduces refrigerant which flows through a pipe extending from the second four-way valve 4 to the refrigerant-inflow port of the expander 6. It is preferable that the fluid supply pipe 73 is connected to the inflow side pipe of the pre-expansion valve 5.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5 and the expander 6 through the second four-way valve 4, and is expanded by the pre-expansion valve 5 and the expander 6. Power recover by the expander 6 at the time of expanding operation is used for driving the compressor 1. At that time, the opening of the control valve 7 is adjusted in accordance with a high pressure detected at an outlet of the outdoor heat exchanger 3, thereby controlling an amount of refrigerant which is allowed to flow into the bypass circuit. The opening of the pre-expansion valve 5 is adjusted in accordance with the detected high pressure, thereby controlling an amount of refrigerant which is allowed to flow into the expander 6.

The $CO_2$ refrigerant expanded by the pre-expansion valve 5 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the compressor 1. At that time, the opening of the control valve 7 is adjusted in accordance with a high pressure detected at an outlet of the indoor heat exchanger 8, thereby controlling an amount of refrigerant which is allowed to flow into the bypass circuit. The opening of the pre-expansion valve 5 is adjusted in accordance with the detected high pressure, thereby controlling an amount of refrigerant which is allowed to flow into the expander 6.

The $CO_2$ refrigerant expanded by the pre-expansion valve 5 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

High pressure refrigerant in the supercritical state is introduced into the back pressure chamber 68*a* in the expander 6 by the fluid supply pipe 73, and the high pressure refrigerant reliably pushes the vane 69 against the inner peripheral surface of the cylinder 61.

In this embodiment, the fluid supply pipe 73 introduces the refrigerant which flows through the pipe extending from the second four-way valve 4 to the refrigerant-inflow port of the expander 6, but the fluid supply pipe 73 may introduces refrigerant which flows through a pipe extending from a discharge port of the compressor 1 to the first four-way valve 2.

A refrigeration cycle apparatus using an expander according to the embodiment of the present invention will be explained with reference to the drawing based on a heat pump type cooling and heating air conditioner of another embodiment.

Figure 4:
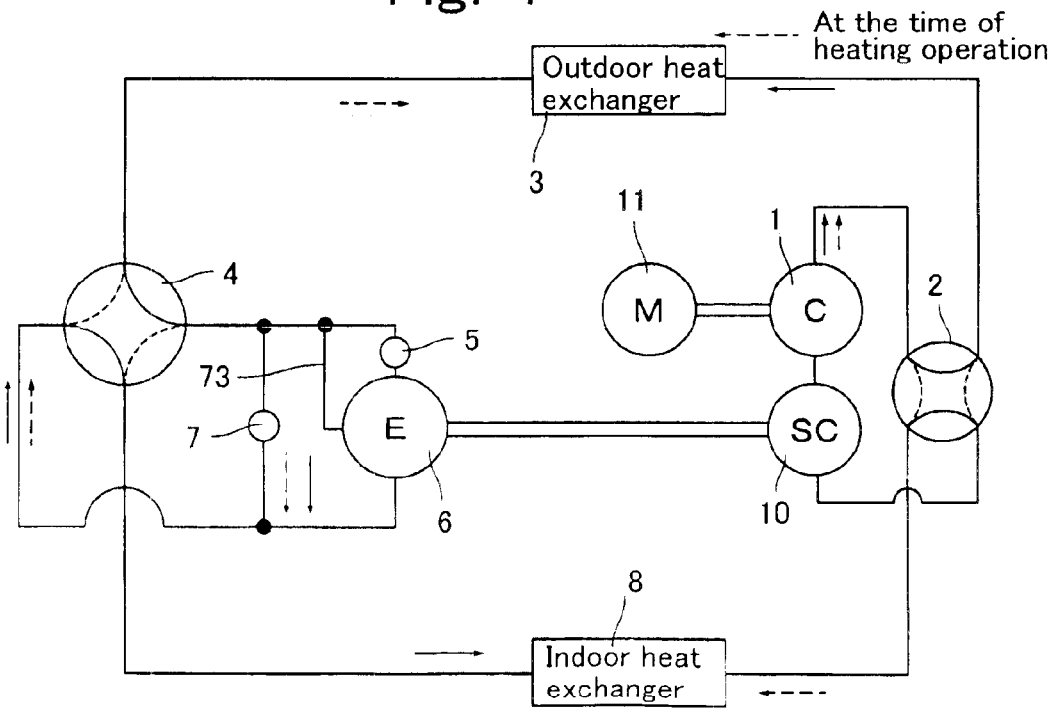
FIG. 4 shows a structure of a heat pump type cooling and heating air conditioner of another embodiment of the invention.

FIG. 4 shows a structure of the heat pump type cooling and heating air conditioner of this embodiment.

As shown in FIG. 4, the heat pump type cooling and heating air conditioner of this embodiment uses a $CO_2$ refrigerant as refrigerant, and comprises a refrigerant circuit in which a compressor 1 having a motor 11, an outdoor heat exchanger 3, an expander 6, an indoor heat exchanger 8 and an auxiliary compressor 10 are connected to one another through pipes.

The expander 6 is provided at its inflow side pipe with a pre-expansion valve 5.

A bypass circuit which bypasses the pre-expansion valve 5 and the expander 6 is provided in parallel to the pre-expansion valve 5 and the expander 6. The bypass circuit is provided with a control valve 7.

A drive shaft of the expander 6 and a drive shaft of the auxiliary compressor 10 are connected to each other, and the auxiliary compressor 10 is driven by power recover by the expander 6.

The refrigerant circuit is provided with a first four-way valve 2 to which a discharge side pipe of the compressor 1 and a suction side pipe of the auxiliary compressor 10 are connected, and a second four-way valve 4 to which a refrigerant-inflow side pipe of the pre-expansion valve 5, a refrigerant-outflow side pipe of the expander 6 and the bypass circuit are connected.

The fluid supply pipe 73 introduces refrigerant which flows through a pipe extending from the second four-way valve 4 to the refrigerant-inflow port of the expander 6. It is preferable that the fluid supply pipe 73 is connected to the inflow side pipe of the pre-expansion valve 5.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the auxiliary compressor 10. At that time, the opening of the control valve 7 is adjusted in accordance with a high pressure detected at an outlet of the outdoor heat exchanger 3, thereby controlling an amount of refrigerant which is allowed to flow into the bypass valve. The opening of the pre-expansion valve 5 is adjusted in accordance with the detected high pressure, thereby controlling an amount of refrigerant which is allowed to flow into the expander 6.

The $CO_2$ refrigerant expanded by the pre-expansion valve 5 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is introduced into the auxiliary compressor 10 through the first four-way valve 2 and supercharged by the auxiliary compressor 10 and is drawn into compressor 1.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the auxiliary compressor 10. At that time, the opening of the control valve 7 is adjusted in accordance with a high pressure detected at an outlet of the indoor heat exchanger 8, thereby controlling an amount of refrigerant which is allowed to flow into the bypass valve. The opening of the pre-expansion valve 5 is adjusted in accordance with the detected high pressure, thereby controlling an amount of refrigerant which is allowed to flow into the expander 6.

The $CO_2$ refrigerant expanded by the pre-expansion valve 5 and the expander 6 is introduced into the outdoor heat exchanger 3 through the second four-way valve 4 and is evaporated and suctions heat in the outdoor heat exchanger 3. The refrigerant which has been evaporated is introduced into the auxiliary compressor 10 through the first four-way valve 2 and supercharged by the auxiliary compressor 10 and drawn into the compressor 1.

High pressure refrigerant in the supercritical state is introduced into the back pressure chamber 68*a* in the expander 6 by the fluid supply pipe 73, and the high pressure refrigerant reliably pushes the vane 69 against the inner peripheral surface of the cylinder 61.

In this embodiment, the fluid supply pipe 73 introduces the refrigerant which flows through the pipe extending from the second four-way valve 4 to the refrigerant-inflow port of the expander 6, but the fluid supply pipe 73 may introduces refrigerant which flows through a pipe extending from a discharge port of the compressor 1 to the first four-way valve 2.

A refrigeration cycle apparatus using an expander according to the embodiment of the present invention will be explained with reference to the drawing based on a heat pump type cooling and heating air conditioner of another embodiment.

Figure 5:
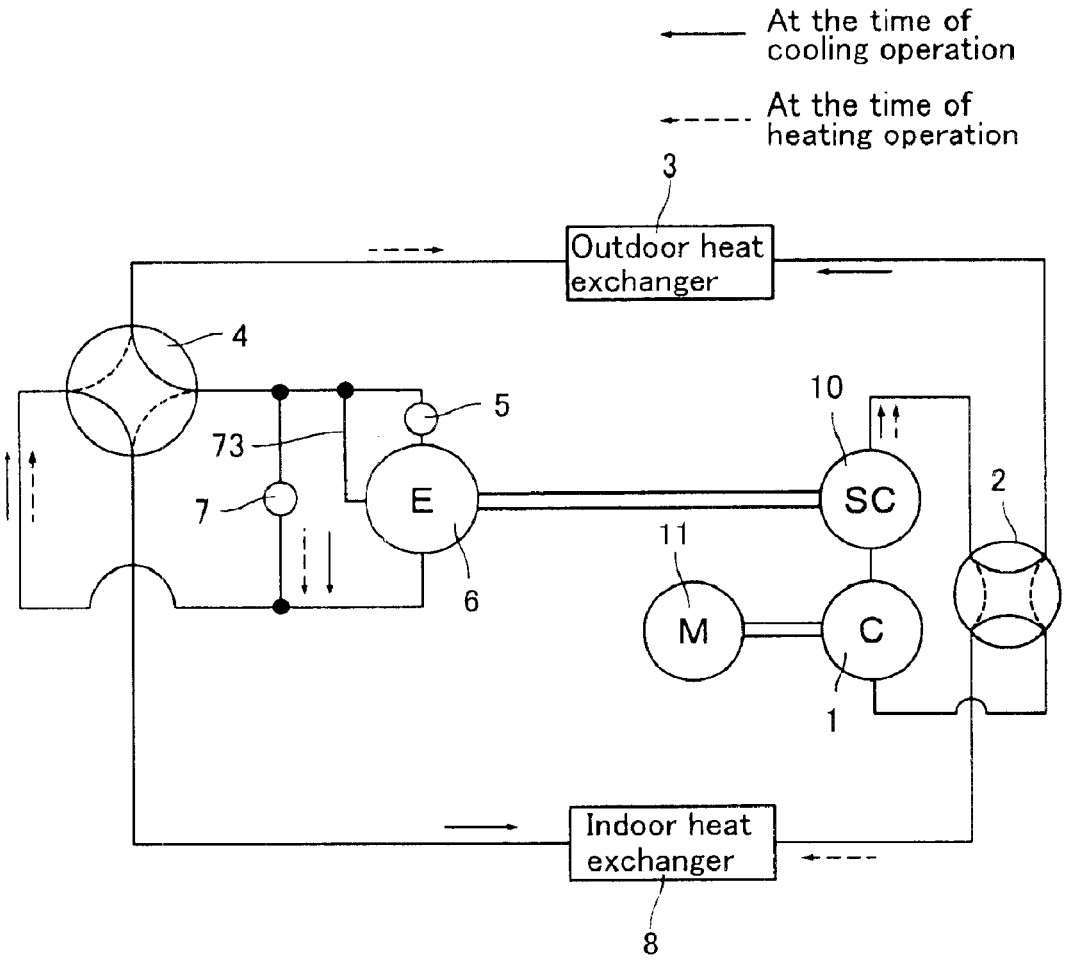
FIG. 5 shows a structure of a heat pump type cooling and heating air conditioner of another embodiment of the invention.

FIG. 5 shows a structure of the heat pump type cooling and heating air conditioner of this embodiment.

As shown in FIG. 5, the heat pump type cooling and heating air conditioner of this embodiment uses a $CO_2$ refrigerant as refrigerant, and comprises a refrigerant circuit in which a compressor 1 having a motor 11, an auxiliary compressor 10, an outdoor heat exchanger 3, an expander 6 and an indoor heat exchanger 8 are connected to one another through pipes.

The expander 6 is provided at its inflow side pipe with a pre-expansion valve 5.

A bypass circuit which bypasses the pre-expansion valve 5 and the expander 6 is provided in parallel to the pre-expansion valve 5 and the expander 6. The bypass circuit is provided with a control valve 7.

A drive shaft of the expander 6 and a drive shaft of the auxiliary compressor 10 are connected to each other, and the auxiliary compressor 10 is driven by power recover by the expander 6.

The refrigerant circuit is provided with a first four-way valve 2 to which a suction side pipe of the compressor 1 and a discharge side pipe of the auxiliary compressor 10 are connected, and a second four-way valve 4 to which a suction side pipe of the pre-expansion valve 5, a discharge side pipe of the expander 6 and the bypass circuit are connected.

The fluid supply pipe 73 introduces refrigerant which flows through a pipe extending from the second four-way valve 4 to the refrigerant-inflow port of the expander 6. It is preferable that the fluid supply pipe 73 is connected to the inflow side pipe of the pre-expansion valve 5.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the auxiliary compressor 10 and super-pressurized by the auxiliary compressor 10 and then, is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the auxiliary compressor 10. At that time, the opening of the control valve 7 is adjusted in accordance with a high pressure detected at an outlet of the outdoor heat exchanger 3, thereby controlling an amount of refrigerant which is allowed to flow into the bypass valve. The opening of the pre-expansion valve 5 is adjusted in accordance with the detected high pressure, thereby controlling an amount of refrigerant which is allowed to flow into the expander 6.

The $CO_2$ refrigerant expanded by the pre-expansion valve 5 and the expander 6 is introduced into the indoor heat exchanger 8 through the second four-way valve 4 and is evaporated and suctions heat in the indoor heat exchanger 8. A room is cooled by this endotherm. The refrigerant which has been evaporated is drawn into compressor 1 through the first four-way valve 2.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the auxiliary compressor 10 and super-pressurized by the auxiliary compressor 10 and then, is introduced into the indoor heat exchanger 8 through the first four-way valve 2. In the indoor heat exchanger 8, since $CO_2$ refrigerant is in a supercritical state, the refrigerant is not brought into two-phase state, and dissipates heat to outside fluid such as air and water. A room is heated utilizing this radiation. Then, the $CO_2$ refrigerant is introduced into the pre-expansion valve 5 and the expander 6, and is expanded by the pre-expansion valve 5 and the expander 6. Power recover by the expander 6 at the time of expanding operation is used for driving the auxiliary compressor 10. At that time, the opening of the control valve 7 is adjusted in accordance with a high pressure detected at an outlet of the indoor heat exchanger 8, thereby controlling an amount of refrigerant which is allowed to flow into the bypass circuit. The opening of the pre-expansion valve 5 is adjusted in accordance with the detected high pressure, thereby controlling an amount of refrigerant which is allowed to flow into the expander 6.

The $CO_2$ refrigerant expanded by the pre-expansion valve 5 and the expander 6 is introduced into the outdoor heat exchanger 3 through the second four-way valve 4 and is evaporated and suctions heat in the outdoor heat exchanger 3. The refrigerant which has been evaporated is drawn into the compressor 1 through the first four-way valve 2.

High pressure refrigerant in the supercritical state is introduced into the back pressure chamber 68*a* in the expander 6 by the fluid supply pipe 73, and the high pressure refrigerant reliably pushes the vane 69 against the inner peripheral surface of the cylinder 61.

In this embodiment, the fluid supply pipe 73 introduces the refrigerant which flows through the pipe extending from the second four-way valve 4 to the refrigerant-inflow port of the expander 6, but the fluid supply pipe 73 may introduces refrigerant which flows through pipe extending from a discharge port of the compressor 1 to the first four-way valve 2.

A refrigeration cycle apparatus using an expander according to the embodiment of the present invention will be explained with reference to the drawing based on a heat pump type cooling and heating air conditioner of another embodiment.

Figure 6:
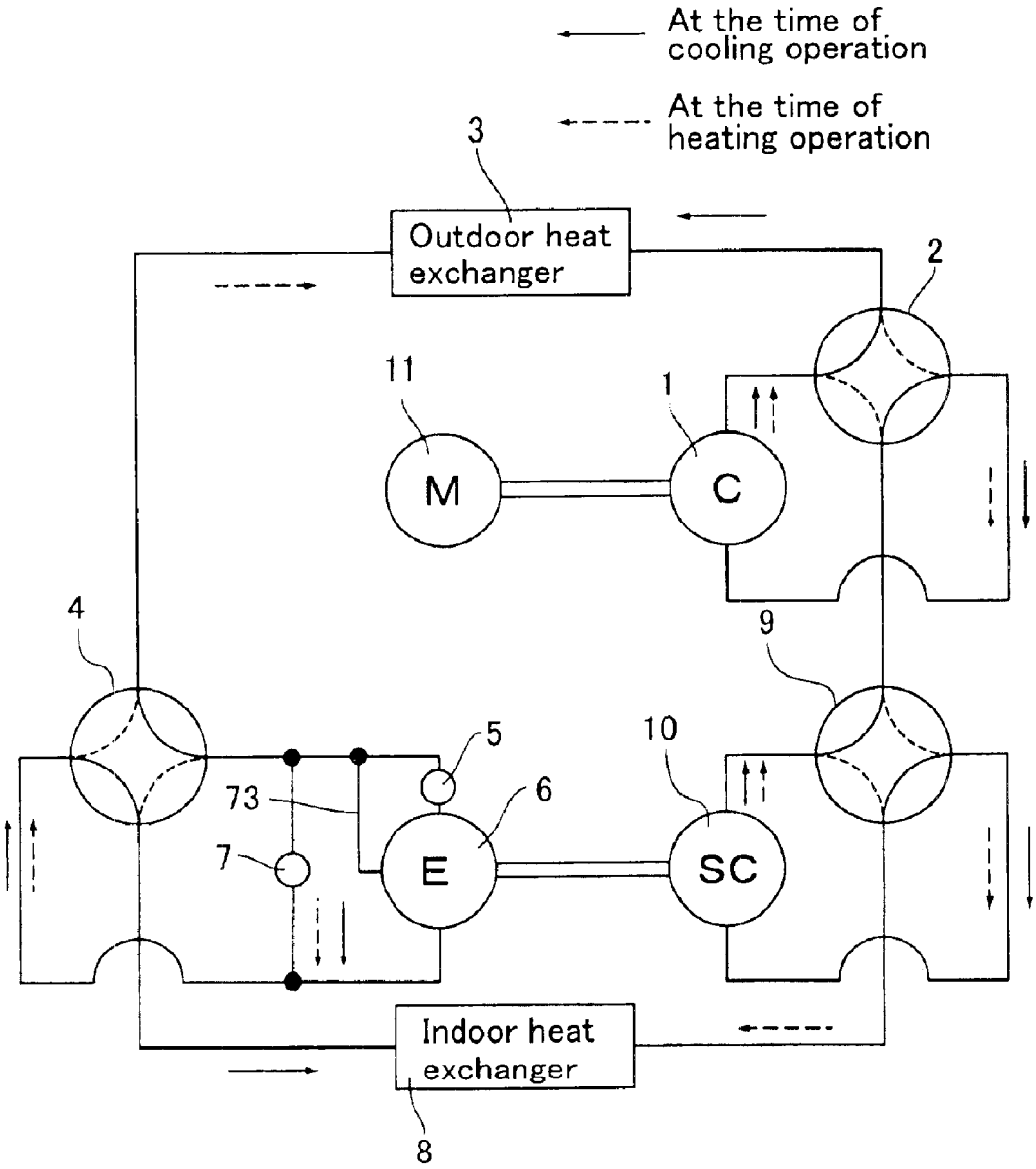
FIG. 6 shows a structure of a heat pump type cooling and heating air conditioner of another embodiment of the invention.

FIG. 6 shows a structure of the heat pump type cooling and heating air conditioner of this embodiment.

As shown in FIG. 6, the heat pump type cooling and heating air conditioner of this embodiment uses a $CO_2$ refrigerant as refrigerant, and comprises a refrigerant circuit in which a compressor 1 having a motor 11, an outdoor heat exchanger 3, an expander 6, an indoor heat exchanger 8 and an auxiliary compressor 10 are connected to one another through pipes.

The refrigerant circuit comprises a first four-way valve 2 to which a discharge side pipe and a suction side pipe of the compressor 1 are connected, a second four-way valve 4 to which a discharge side pipe and a suction side pipe of the expander 6 are connected, and a third four-way valve 9 to which a discharge side pipe and a suction side pipe of the auxiliary compressor 10 are connected. In the case of refrigerant flow in which the outdoor heat exchanger 3 is used as a gas cooler and the indoor heat exchanger 8 is used as an evaporator, the first four-way valve 2 and the third four-way valve 9 are switched over so that the discharge side of the auxiliary compressor 10 becomes the suction side of the compressor 1. In the case of refrigerant flow in which the outdoor heat exchanger 3 is used as the evaporator and the indoor heat exchanger 8 is used as the gas cooler, the first four-way valve 2 and the third four-way valve 9 are switched over so that the discharge side of the compressor 1 becomes the suction side of the auxiliary compressor 10. By switching the second four-way valve 4, a direction of the refrigerant flowing through the expander 6 becomes always the same direction.

The expander 6 is provided at its inflow side with a pre-expansion valve 5 capable of changing the opening of the valve.

A bypass circuit which bypasses the pre-expansion valve 5 and the expander 6 is provided. The bypass circuit is provided with a bypass valve 7 which adjusts a flow rate of refrigerant of the bypass circuit.

A drive shaft of the expander 6 and a drive shaft of the auxiliary compressor 10 are connected to each other, and the auxiliary compressor 10 is driven by power recover by the expander 6.

The fluid supply pipe 73 introduces refrigerant which flows through a pipe extending from the second four-way valve 4 to the refrigerant-inflow port of the expander 6. It is preferable that the fluid supply pipe 73 is connected to the inflow side pipe of the pre-expansion valve 5.

The operation of the heat pump type cooling and heating air conditioner of this embodiment will be explained.

First, a cooling operation mode in which the outdoor heat exchanger 3 is used as a gas cooler and the indoor heat exchanger 8 is used as an evaporator will be explained. A flow of the refrigerant in the cooling operation mode is shown with solid arrows in the drawing.

Refrigerant at the time of the cooling operation mode is compressed at a high temperature and under a high pressure and is discharged by the compressor 1 which is driven by the motor 11. The refrigerant is introduced into the outdoor heat exchanger 3 through the first four-way valve 2. In the outdoor heat exchanger 3, since $CO_2$ refrigerant is in a supercritical state, the refrigerant is not brought into two-phase state, and dissipates heat to outside fluid such as air and water. Then, the $CO_2$ refrigerant is introduced into the second four-way valve 4, the pre-expansion valve 5 and the expander 6, and is expanded by the expander 6. At that time, an optimal amount of refrigerant flowing into the expander 6 is calculated from a high pressure refrigerant temperature and a high pressure refrigerant pressure detected on the side of the outlet of the outdoor heat exchanger 3. The opening of the pre-expansion valve 5 or the bypass valve 7 is adjusted such that if the volume flow rate is greater than the calculated optimal refrigerant amount, the opening of the bypass valve 7 is increased to reduce the volume flow rate of refrigerant flowing into the expander 6, and if the volume flow rate is smaller than the calculated optimal refrigerant amount, the opening of the pre-expansion valve 5 is reduced to increase the volume flow rate. The expanded $CO_2$ refrigerant is evaporated and suctions heat in the indoor heat exchanger 8 through the second four-way valve 4. A room is cooled by this endotherm. The refrigerant which has been evaporated is introduced into the auxiliary compressor 10 through the third four-way valve 9 and supercharged by the auxiliary compressor 10, and is drawn into the compressor 1 through the third four-way valve 9 and the first four-way valve 2. Energy generated when expansion is carried out in the expander 6 is utilized for this supercharging operation of the auxiliary compressor 10, and power is recovered.

Next, a heating operation mode in which the outdoor heat exchanger 3 is used as the evaporator and the indoor heat exchanger 8 is used as the gas cooler will be explained. A flow of a refrigerant in this heating operation mode is shown with dashed arrows in the drawing.

Refrigerant at the time of the heating operation mode is compressed at a high temperature and under a high pressure and is discharged by the compressor 1 which is driven by the motor 11. The refrigerant is introduced into the auxiliary compressor 10 through the first four-way valve 2 and the third four-way valve 9, and further super-pressurized by the auxiliary compressor 10. The expansion energy at the expander 6 is utilized for this super-pressurizing operation and power into the indoor heat exchanger 8 through the third four-way valve 9. In the indoor heat exchanger 8, since $CO_2$ refrigerant is in a supercritical state, the refrigerant is not brought into two-phase state, and dissipates heat to outside fluid such as air and water. Then, the $CO_2$ refrigerant is introduced into the expander 6 through the second four-way valve 4 and the pre-expansion valve 5, and is expanded by the expander 6. At that time, an optimal amount of refrigerant flowing into the expander 6 is calculated from a high pressure refrigerant temperature and a high pressure refrigerant pressure detected on the side of the outlet of the indoor heat exchanger 8. The opening of the pre-expansion valve 5 or the bypass valve 7 is adjusted such that if the volume flow rate is greater than the calculated optimal refrigerant amount, the opening of the bypass valve 7 is increased to reduce the volume flow rate of refrigerant flowing into the expander 6, and if the volume flow rate is smaller than the calculated optimal refrigerant amount, the opening of the pre-expansion valve 5 is reduced to increase the volume flow rate. The expanded $CO_2$ refrigerant is evaporated and suctions heat in the outdoor heat exchanger 3 through the second four-way valve 4. The refrigerant which has been evaporated is drawn into the compressor 1 through the first four-way valve 2.

High pressure refrigerant in the supercritical state is introduced into the back pressure chamber 68*a* in the expander 6 by the fluid supply pipe 73, and the high pressure refrigerant reliably pushes the vane 69 against the inner peripheral surface of the cylinder 61.

In this embodiment, the fluid supply pipe 73 introduces the refrigerant which flows through the pipe extending from the second four-way valve 4 to the refrigerant-inflow port of the expander 6, but the fluid supply pipe 73 may introduces refrigerant which flows through a pipe extending from a discharge port of the compressor 1 to the first four-way valve 2.

According to this embodiment, the compressor 1 which compresses refrigerant and the expander 6 and the auxiliary compressor 10 which recover the power are separated from each other. The refrigeration cycle is switched such that the refrigerant is supercharged by the auxiliary compressor 10 at the time of the cooling operation mode, and the refrigerant is super-pressurized at the time of the heating operation mode. With this structure, it is possible to allow the expander 6 to operate as a supercharging type expander which is suitable for cooling, and as a super-pressurizing type expander which is suitable for heating.

As described above, according to this embodiment, it is possible to provide an air conditioner capable of efficiently operating the refrigeration cycle even in a wide operating range, in which power is recovered while using $CO_2$ refrigerant as refrigerant.

In each of the embodiments, a sliding vane type expander is used as the expander 6, no oil reservoir is provided in a hausing 60, and lubrication in the expander 6 is carried out using oil mist discharged from the compressor 1. Therefore, it is possible to avoid a problem that oil level in each of a plurality of oil reservoirs must be controlled. Especially when the auxiliary compressor 10 and the expander 6 are connected to each other and the auxiliary compressor 10 supercharges and super-pressurizes as in the embodiment shown in FIG. 6, since the expander 6 does not have the oil reservoir, it is possible to integrally form the auxiliary compressor 10 and the expander 6.

Although the above embodiments have been described using the heat pump type cooling and heating air conditioner, the present invention can also be applied to other refrigeration cycle apparatuses in which the outdoor heat exchanger 3 is used as a first heat exchanger, the indoor heat exchanger 8 is used as a second heat exchanger, and the first and second heat exchangers are utilized for hot and cool water devices or thermal storages.

In the embodiments, the drive shaft of the expander 6 is connected to the drive shaft of the compressor 1 or the auxiliary compressor 10, and power recover by the expander 6 is utilized for driving the compressor 1 or the auxiliary compressor 10, but the drive shaft of the expander 6 may be provided with an electric generator to convert the power into electricity.

The compressor 1 and the auxiliary compressor 10 explained in the above embodiments can be formed into a sliding vane type compressor explained in FIG. 1 and FIG. 2. In this case, the expansion space is formed into a compression space. Especially when the auxiliary compressor 10 is formed into the sliding vane type compressor, the expander 6 and the auxiliary compressor 10 can be lubricated only with oil mist discharged from the compressor 1, and the expander 6 and the auxiliary compressor 10 do not require a hausing having an oil reservoir.

As described above, according to the present invention, by introducing the refrigerant in the supercritical state, since the refrigerant is not in the gas state, it is possible to reduce the leakage of refrigerant from a gap between a vane groove and a vane.

According to the invention, a portion of refrigerant flowing through the suction pipe is introduced into the back pressure chamber, and since it is unnecessary to separately introduce refrigerant from outside of the expander, the mechanism can be simplified.

What is claimed is:

1. An expander used in a refrigeration cycle using carbon dioxide as refrigerant and having a compressor, an outdoor heat exchanger and an indoor heat exchanger, wherein said expander comprises a cylindrical cylinder, a rotor which rotates in said cylinder, a vane which divides an expansion space formed between an inner peripheral surface of said cylinder and an outer peripheral surface of said rotor into a plurality of spaces, and a vane groove provided in said rotor for accommodating said vane therein, and wherein said vane groove is provided with a back pressure chamber which pushes said vane against the inner peripheral surface of said cylinder, and said refrigerant in the supercritical state is introduced into said back pressure chamber, wherein the expander is lubricated by oil mist discharged from the compressor.

2. An expander according to claim 1, further comprising a suction pipe which introduces refrigerant into said expansion space, wherein a portion of refrigerant flowing through said suction pipe is introduced into said back pressure chamber.

3. An expander according to claim 1, wherein no oil reservoir is provided in a hausing which includes said cylinder or said rotor therein.

4. A refrigeration cycle apparatus having a refrigeration cycle using carbon dioxide as refrigerant and having a compressor, an outdoor heat exchanger, an expander and an indoor heat exchanger, said refrigeration cycle apparatus including, in said refrigeration cycle, a first four-way valve to which a discharge side pipe and a suction side pipe of said compressor are connected, and a second four-way valve to which a refrigerant-inflow side pipe and a refrigerant-outflow side pipe of said expander are, connected, wherein using, as said expander, a sliding vane type expander having a cylindrical cylinder, a rotor which rotates in said cylinder, a vane which divides an expansion space formed between an inner peripheral surface of said cylinder and an outer peripheral surface of said rotor into a plurality of spaces, and a vane groove provided in said rotor for accommodating said vane therein, refrigerant flowing through a pipe extending from said second four-way valve to a refrigerant-inflow port of said expander is introduced into a back surface of said vane, wherein the expander is lubricated by oil mist discharged from the compressor.

5. A refrigeration cycle apparatus having a refrigeration cycle using carbon dioxide as refrigerant and having a compressor, an outdoor heat exchanger, an expander and an indoor heat exchanger, said refrigeration cycle apparatus including, in said refrigeration cycle, a first four-way valve to which a discharge side pipe and a suction side pipe of said compressor are connected, and a second four-way valve to which a refrigerant-inflow side pipe and a refrigerant-outflow side pipe of said expander are connected, wherein using, as said expander, a sliding vane type expander having a cylindrical cylinder, a rotor which rotates in said cylinder, a vane which divides an expansion space formed between an inner peripheral surface of said cylinder and an outer peripheral surface of said rotor into a plurality of spaces, and a vane groove provided in said rotor for accommodating said vane therein, refrigerant flowing through a pipe extending from a discharge port of said compressor to said first four-way valve is introduced into a back surface of said vane, wherein the expander is lubricated by oil mist discharged from the compressor.

6. A compressor used in a refrigeration cycle using carbon dioxide as refrigerant and having an outdoor heat exchanger and an indoor heat exchanger and an expander, wherein said compressor comprises a cylindrical cylinder, a rotor which rotates in sail cylinder, a vane which divides a compression space formed between an inner peripheral surface of said cylinder and an outer peripheral surface of said rotor into a plurality of spaces, and a vane groove provided in said rotor for accommodating said vane therein, and wherein said vane groove is provided with a back pressure chamber which pushes said vane against the inner peripheral surface of said cylinder, and said refrigerant in the supercritical state is introduced into said back pressure chamber, wherein the expander is lubricated by oil mist discharged from the compressor.

7. A compressor according to claim 6, further comprising a discharge pipe which discharges refrigerant from said compression space, wherein a portion of refrigerant flowing through said discharge pipe is introduced into said back pressure chamber.

* * * * *